United States Patent [19]

Shields

[11] Patent Number: 4,781,827

[45] Date of Patent: Nov. 1, 1988

[54] PORTABLE SWIMMING POOL SKIMMER

[75] Inventor: Edward J. Shields, Boca Raton, Fla.

[73] Assignee: Marlene L. Shields, Boca Raton, Fla.

[21] Appl. No.: 52

[22] Filed: Jan. 2, 1987

[51] Int. Cl.[4] ..... E04H 3/20

[52] U.S. Cl. ..... 210/169; 210/242.1; 210/416.2; 134/167 R; 4/490

[58] Field of Search ..... 210/169, 416.2, 242.1, 210/238, 163; 134/167 R; 15/1.7; 4/490; 248/DIG. 10

[56] References Cited

U.S. PATENT DOCUMENTS

| | | | |
|---|---|---|---|
| 3,036,712 | 5/1962 | Barbara | 210/169 |
| 3,078,998 | 2/1963 | Blumenfeld | 210/169 |
| 3,119,588 | 1/1964 | Keats | 248/DIG. 10 |
| 3,152,076 | 10/1964 | Kreutzer | 210/169 |
| 3,186,550 | 6/1965 | Beduhn | 210/242.1 |
| 3,263,811 | 2/1963 | Baker et al. | 210/169 |
| 3,268,079 | 8/1966 | Sharrow, Jr. | 210/169 |
| 3,321,080 | 3/1967 | Pansini et al. | 210/169 |
| 3,372,809 | 3/1968 | Spitzer | 210/169 |
| 3,567,019 | 3/1971 | Headrick | 210/242.1 |
| 3,765,432 | 10/1973 | Goodin | 15/1.7 |
| 3,860,518 | 1/1975 | Henricksen | 210/169 |
| 4,089,074 | 5/1978 | Sermons | 4/490 |
| 4,105,557 | 8/1978 | Weatherbolt | 15/1.7 |
| 4,378,254 | 3/1983 | Chauvier | 210/169 |

*Primary Examiner*—Richard V. Fisher
*Assistant Examiner*—Coreen Y. Lee
*Attorney, Agent, or Firm*—Harry W. Barron

[57] ABSTRACT

Disclosed herein is a portable swimming pool skimmer which can be positioned at any point along the periphery of a swimming pool. The portable skimmer includes a weighted base member from which extends in on outward and downward direction a bracket for holding a skimmer basket. The bracket is vertically adjustable so that the skimmer basket is positioned slightly below the water surface to allow a skimming action. At the bottom of the basket, a fitting to which one end of a pool hose may be attached is provided. The other end of the pool hose is attached to a suction line from the pool pump and filter assembly, which suction line may be a part of a built in skimmer or another hose from the built in skimmer to another device, such as an automatic pool cleaner. In the latter situation, a restriction in the skimmer hose is provided to minimize the suction pressure which operates the pool cleaning device. A debris guide is also provided to direct the floating debris towards the basket and is selectably positioned by the user in response to the current direction of the pool water. The bracket holding the skimmer basket is fabricated from tubular material and holes are provided in the tubular material to allow water to enter and prevent the bracket from floating.

18 Claims, 1 Drawing Sheet

PORTABLE SWIMMING POOL SKIMMER

This invention relates to a swimming pool skimmer for removing floating debris from the surface of a swimming pool and more particularly, to such a skimmer which can be placed at any point along the periphery of the pool and used in conjunction with other pool cleaning items.

Swimming pools have become very popular additions to a average home. Whenever the homeowner builds the pool, a certain amount of maintenance and hence, time, is required. Much of the manual maintenance once required has been replaced by apparatus which operates in response to a circulating pump system. For example, a filter and automatic chemical dispenser are often used to maintain the purity of the water. Further, swimming pool skimmers, which either may be built in to the side walls of built in swimming pools or affixed to fix over the sides of above the ground swimming pools, operate to remove floating debris, such as bugs and leaves, from the water surface of the pool. Such swimming pool skimmers are shown, for example, in U.S. Pat. Nos. 3,268,079, 3,616,918, 3,186,550, 3,263,811, 3,036,712, 3,372,809, 3,774,767 and 4,455,695.

As can be seen by a review of each of the above noted prior art patents, several disadvantages for use in the modern swimming pool are apparent. First, each of the skimmers is designed for permanent affixation to a single position along one side of the pool. Further, each of the skimmers shown in the prior art is not adapted for use when the suction line to the pump to which it is to be coupled is being used by another cleaning device. For example, automatic floor cleaning devices have become popular in recent years. These type of devices have a hose extending therefrom to the section line to the filter and pump mechanism. Typically, there are only two such suction lines to the filter and pump mechanism and these are the skimmer and the floor drain. In order to connect the automatic cleaning device to the filter and pump mechanism, the pool owner generally uses the skimmer suction line to the filter and pump mechanism, since it is the easily accessible one of the suction lines. This of course, renders the skimmer itself useless.

Another problem with the permanently positioned skimmers is that on some days, the wind is blowing in the wrong direction. While most properly designed pools have two or more outlets from the filter and pump assembly which cause the water to circulate, the surface circulation is easily overcome by a strong wind in a direction away from the skimmer. This wind, in turn, causes the surface debris desired to be removed by the skimmer to be blown to the other side of the pool. The permanently affixed skimmers of the prior art can not be moved to where the debris is and hence, the debris remains.

In accordance with one aspect of this invention, there is provided a portable skimmer for a swimming pool for skimming off floating debris from the pool water surface, with the pool including pump means having a water suction line attached thereto. The portable skimmer has a weighted base member and a basket having an open top and an outlet fitting. In addition, the portable skimmer has means, extending downward from the base member, for holding the basket in a position so that the open top is slightly below the water surface and means for connecting the outlet fitting to a water suction line.

One preferred embodiment of the subject invention is hereafter described with reference being made to the following Figures, in which.

Figure 1:
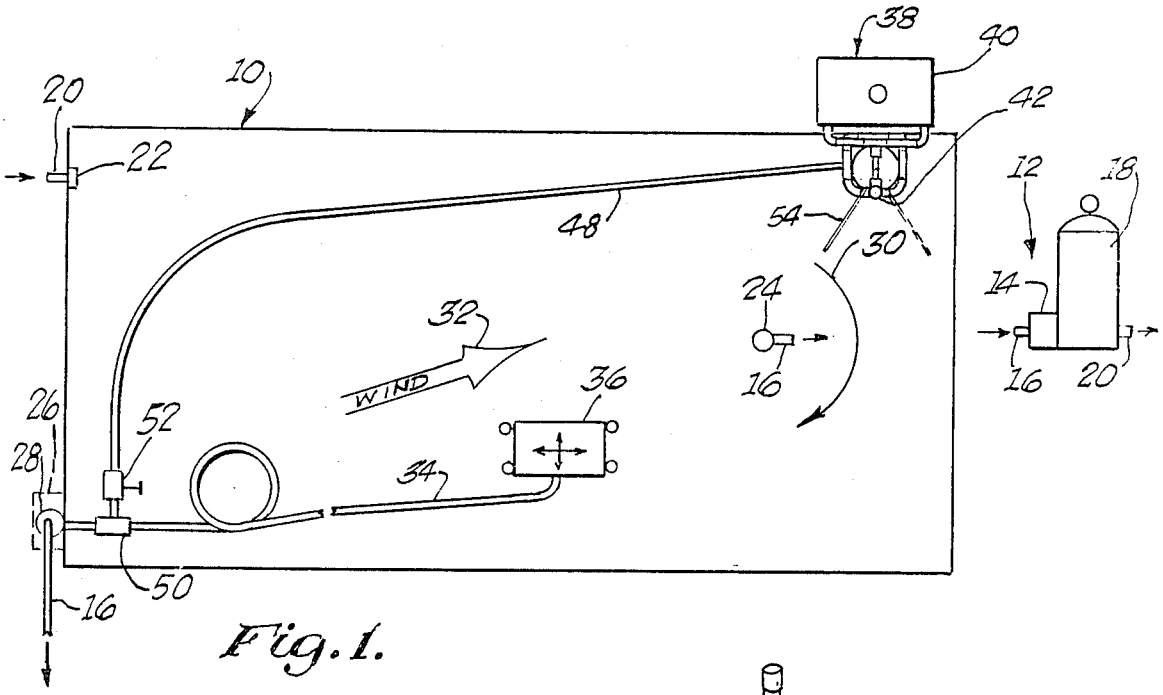
FIG. 1 shows a top view of a swimming pool in which the portable skimmer of the subject invention is used.

Referring now to FIG. 1, a swimming pool 10 is shown in which the subject invention is used. Pool 10 includes a pump and filter assembly 12 having a pump 14 for pumping water from pool 10 coupled thereto through a suction line, or pipe 16, through a filter 18 to a pressure return line, or pipe 20. The water is pumped out through line 20 to a pair of pool inlets 22 built into the side walls of pool 20. Inlets 22 should be positioned on opposite short walls sides of pool 10, slightly removed, by approximately one foot, from opposite long side walls of pool 10.

Swimming pool 10 also includes a main drain 24, positioned in the floor of the deep end of pool 10, and coupled to suction line 16. Further, pool 10 includes a built in skimmer 26 of conventional design in the one of the short walls furthest from main drain 24 and on the opposite side of that short wall with respect to the position of inlet 22. Skimmer 26 includes an outlet 28 connected to suction line 16, thereby allowing water to enter skimmer 26 over a floating device which remains positioned slightly below the surface of the water in pool 10. This skimming action removes surface debris from the water, such as bugs, twigs and leaves.

The above described positioning of the inlets 22 and skimmer 26 is designed to cause a circular current to flow in the pool, as indicated by arrow 30, to bring the debris close to the skimmer 26, whereby it can be removed by the skimmer 26. However, if the wind is blowing away from skimmer 26, as indicated by arrow 32, then the surface of the water will not follow the direction of the current 30 and the surface debris will be blown to the corner of pool 10 away from skimmer 26. Hence, the debris will not be removed. It should be noted that such a wind 32 can last for several days in some areas, potentially allowing bacteria or algae to buildup in the pool water.

Outlet 28 is designed so that one end of a pool hose 34 may be coupled thereto to cause water to enter the other end of the hose 34, rather than flow over the floating device of skimmer 26. An attachment, such as an automatic vacuum cleaning device 36, may be coupled to the other end of hose 34. When this occurs, the skimming action of skimmer 26 is disabled. In many instances, the automatic vacuum cleaning device 36 will remain connected through hose 34 for long periods of time, such as overnight or for several days at a time. Thus, debris can buildup on the surface of the pool, again potentially allowing bacteria or algae to buildup in the pool water.

In order to overcome the problem of skimmer 26 not being able to do its intended job, portable skimmer 38 is provided and can be placed at any location desired around the periphery of pool 10. For example, as shown in FIG. 1, when wind 32 is blowing, portable skimmer 38 is placed at the corner of pool 10 towards which the wind 32 blows. Skimmer 38 includes a weighted base 40 and a bracket 42 extending from base 40 for holding a skimmer basket 44 in a position slightly below the surface of the water in pool 10. Skimmer basket 44 has an open top and closed sides and bottom, except for an outlet 46 in one of the sides or bottom. Outlet 46, in turn, has one end of a hose 48 coupled thereto and the other end of hose 48 is coupled to the suction line 16. The other end of hose 48 may be coupled directly to skimmer outlet 28 or, as seen in FIG. 1, to a Tee fitting 50 placed in hose 34, if it is desired to use skimmer 38 and automatic floor cleaning device 36 at the same time. In order to allow sufficient suction pressure for operating device 36, a restrictor 52, such as an adjustable valve, may be added to line 48. When the suction pressure from portable skimmer 38 is reduced by restrictor 52, it may be desirable to add a guide 54 to the bracket 42, such that the guide 54 extends outward and upstream from bracket 42 and basket 44. Guide 54, hence, directs floating debris towards basket 44 as the floating debris is moved by the current 30.

The restrictor 52 is a restrictive flow means and connects the outlet fitting 42 at the bottom of the basket 44 to the filter inlet 16. The restrictor 52 has a smaller cross sectional area than the cross sectional area than of the outlet fitting 42 so as to minimize the effect on the operation of the apparatus 36 for performing other cleaning tasks.

Figure 2:
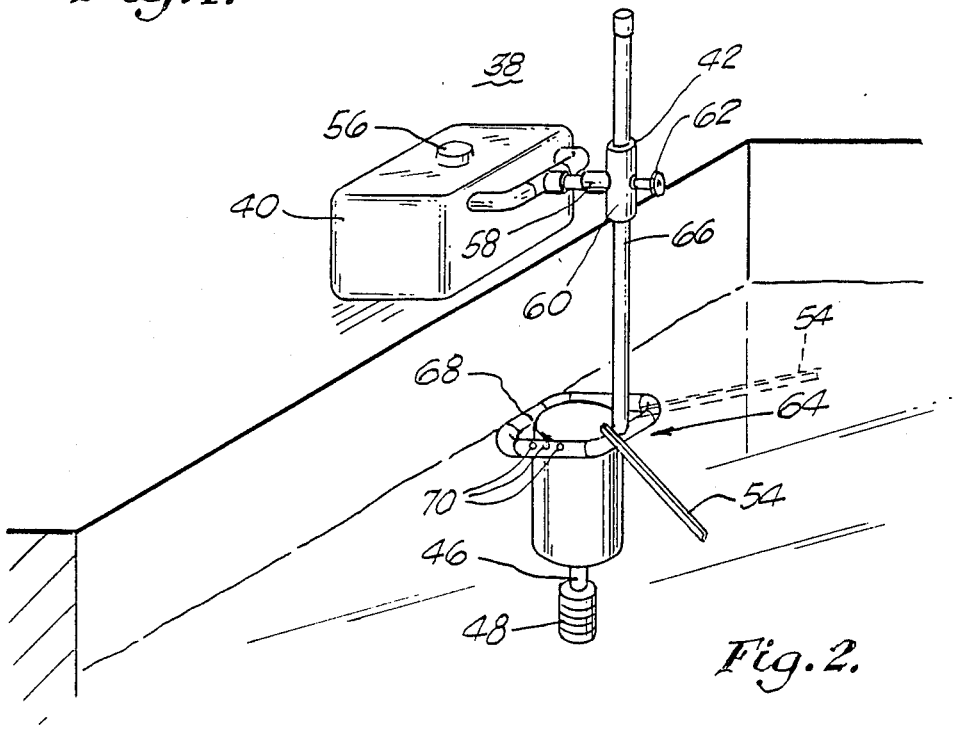
FIG. 2 shows a prospective view of the portable skimmer of the subject invention.

Referring now to FIG. 2, a more detailed diagram of portable skimmer 38 is shown. Where like components are shown in both FIGS. 1 and 2, like numerical designations are used. Base 40 may be a hollow plastic case adapted to having either water or sand poured therein through opening 56 to provide the needed weight. Base 40 should be large enough so that when the weight material, water or sand, is added, bracket 42, which extends outward and downward from base 40, does not tip base 40. While not shown in FIG. 2, a handle may be added to base 40 for ease of moving portable skimmer 38 from one position to another position around pool 10.

Bracket 42 includes a horizontal support 58 extending into and, if desired for additional support, through base 40. A slide housing is affixed to the end of support 58 remote from base 40, through which a basket support 64 may slide in the vertical direction and may be secured at a desired position by a securing member, such as thumb screw 62. Basket support 64 includes a pipe 66, adapted to slide through housing 60, attached to a basket holder 68 into which basket 44 fits and is compressively held. Basket 44 may be removed from holder 68 to remove large items of debris, such as leaves. Alternatively, basket 44 may be affixed directly to pipe 66. However, by properly selecting the size of basket holder 68 so that the end thereof remote from pipe 66 is in the same vertical plane as the end of base 40 from which support 58 exits, the proper positioning of basket slightly away from the pool 10 wall may be easily accomplished by merely setting base 40 on the edge of pool 10. One preferred manner of fabricating bracket 42, including basket holder 68, is to use plastic tube materials. However, tubular material may cause basket holder 68 to tend to float, so holes 70 are placed in the tube material of basket holder 68 to allow water to enter and thus avoid the flotation problem.

As previously mentioned, basket 44 should be positioned to be slightly below the surface of the pool 10 water. As used herein, slightly below the surface is intended to mean that with the suction pressure provided through hose 48, the water entering over the top of basket 40 includes the water on the surface of pool 10 and not primarily water below the surface; on the other hand, slightly below the surface also requires that sufficient water, both surface and subsurface, must enter basket 44 to prevent any air from entering into hose 48. In order to properly position basket 44, pipe 66 slides through support 60 and is secured by thumb screw 62 at the proper position. In order to avoid adjusting the position of pipe 66 each time the water level in pool 10 changes, a floating weir (not shown) may be included with basket 44. Such a floating weir is well known in the prior art.

Figure 3:
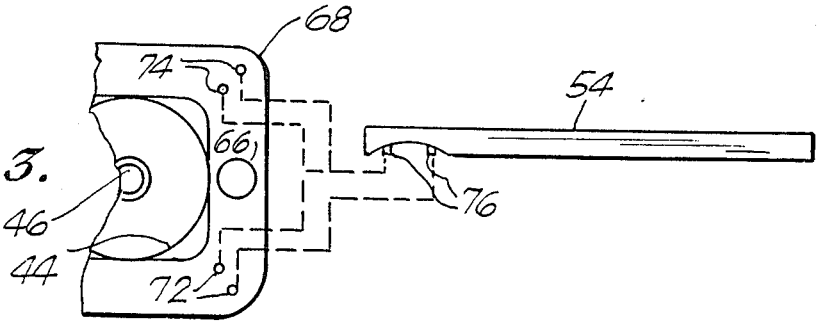
FIG. 3 shows a detailed top view of the connection of the debris guide to the portable skimmer of the subject invention.

Guide 54 may be attached to basket holder 68 at approximately a 5° angle outward and upstream from holder 68. In order to utilize guide 54 in any pool, guide 54 should be made adjustable on holder 68 so that, if the current 30 of pool 10 water is opposite to that shown in FIG. 1, a simple adjustment of guide 54 may be made changing the direction from which it extends. Referring to FIG. 3, a pair of holes 72 and 74 are placed at each corner of basket holder 68 on the side to which pipe 66 is attached. Guide 54 has a pair of pins 76, spaced apart and sized to fit into one of the pair of holes 72 or 74 extending from a curved portion 78 of guide 54 designed to fit around the tubular shape of the corner of basket holder 68. Thus, guide 54 may be position, as shown in FIG. 2, by either the solid lines or by the dashed lines. Such positioning would be at the selection of the user of portable skimmer 38 depending on the direction of the current 30 of the water in pool 10. Alternatively, a swinging bracket may be used to attach guide 54 to basket holder 68 or to pipe 66, or even to basket 44.

Thus, portable skimmer 38 may be used to remove floating debris from pool 10 when fixed skimmer 26 is either disabled by having a hose attached therein or when the wind is blowing away from skimmer 26.

What is claimed is:

1. A portable skimmer for a swimming pool for skimming off floating debris from the pool water surface, said pool including pump means having a water suction line attached thereto, said skimmer comprising:

a weighted base member for being selectively positioned at any desired location around the periphery of said pool;

a basket having an open top and an outlet fitting; and tubular basket holding means for holding said basket, said basket holding means having openings therein to allow water from said pool within said tubular means;

means, extending downward from said base member, for supporting said basket holding means in a position so that said open top is slightly below said water surface; and means for connecting said outlet fitting to said water suction line.

2. The invention according to claim 1:

wherein said water suction outlet line includes other apparatus connected thereto; and wherein said means for connecting includes line restriction means.

3. The invention according to claim 2 wherein said means for restricting includes adjustable valve means.

4. The invention according to claim 3 wherein said means for supporting includes means to adjust the position of said basket in a downward direction.

5. The invention according to claim 4 wherein said weighted base is positioned on the side of said pool and said means for supporting extends outward from said side of said pool.

6. The invention according to claim 5 wherein the weight of said weighted base is selected to prevent said skimmer from tipping as a result of said means for supporting extending outward from said base.

7. The invention according to claim 6 wherein said skimmer further includes debris directing means extending outward and in a lateral direction from said basket.

8. The invention according to claim 7 wherein said debris directing means is positioned on said means for holding to extend outward and in a selectable lateral direction from said means for holding, said selectable direction being upstream from the water current flow in said pool.

9. The invention according to claim 1 wherein said skimmer further includes debris directing means extending outward and in a lateral direction from said basket.

10. The invention according to claim 9 wherein said debris directing means is positioned on said means for holding to extend outward and in a selectable lateral direction from said means for holding, said selectable direction being upstream from the water current flow in said pool.

11. The invention according to claim 1 wherein said weighted base is positioned on the side of said pool and said means for supporting extends outward from said side of said pool.

12. The invention according to claim 11 wherein the weight of said weighted base is selected to prevent said skimmer from tipping as a result of said means for supporting extending outward from said base.

13. The invention according to claim 1 wherein said means for supporting includes means to adjust the position of said basket in a downward direction.

14. A portable swimming pool skimmer positionable at any point along the periphery of a swimming pool, said pool having a circular flow of water therein caused by outlets from a pump and filter assembly used to maintain the purity of the water in said pool, said pool further having a suction inlet to said pump and filter assembly to which is coupled suction actuated apparatus for performing other cleaning tasks on said pool, said skimmer comprising:

a weighted base member shaped to sit at any location around the peripheral edge of said pool;

skimmer basket means including an open top and a closed side and bottom assembly with an outlet fitting therein;

holding means including basket holding means and means extending outward and downward from said base member coupled to said basket holding means, said basket holding means holding said top of said basket means in a position below the surface of said water, said extending means being adjustable in a downward direction with respect to said base member, said basket holding means being fabricated from tubular members having openings therein to allow the interior of said tubular members to fill with water from said pool; and restrictive flow means for connecting said outlet fitting at the bottom of said basket to said filter inlet, said restrictive flow means having a smaller cross sectional area than the cross sectional area of said outlet fitting so as to minimize the effect on the operation of said apparatus for performing other cleaning tasks.

15. The invention according to claim 14 wherein said base means is hollow and includes an opening into which water is poured to provide the weight.

16. The invention according to claim 15 wherein said skimmer further includes debris directing means extending outward and in a lateral direction from said skimmer basket means.

17. The invention according to claim 14 wherein said skimmer further includes debris directing means extending outward and in a lateral direction from said skimmer basket means.

18. The invention according to claim 17 wherein said debris directing means is positionable on said means for holding to extend outward and in a selectable lateral direction from said means for holding, said selectable direction being upstream from the water flow in said pool.

* * * * *